United States Patent [19]

Just

[11] 3,975,793

[45] Aug. 24, 1976

[54] EASY-LOCK REMOVABLE DOOR HINGE

[76] Inventor: Anthony H. Just, Univac Park, P.O. Box 3525, St. Paul, Minn.

[22] Filed: Aug. 13, 1975

[21] Appl. No.: 604,414

[52] U.S. Cl. ..... 16/171; 312/245; 16/177

[51] Int. Cl.[2] ..... E05D 1/06

[58] Field of Search ..... 16/177, 178, 147, 179, 16/171, 152, 172, 128 R, 169; 49/388; 312/245, 199

[56] References Cited

UNITED STATES PATENTS

| | | | |
|---|---|---|---|
| 2,901,767 | 9/1959 | Odlum et al. | 16/171 |
| 3,059,271 | 10/1962 | Erickson | 16/177 |
| 3,424,510 | 1/1969 | Moon | 16/171 R |
| 3,471,874 | 10/1969 | Dixon | 16/171 X |
| 3,685,093 | 8/1972 | Sanders et al. | 16/171 X |

*Primary Examiner*—G. V. Larkin

[57] ABSTRACT

A hinge arrangement to permit quick removal of a cabinet door without interference with adjacent cabinets. The hinge arrangement is so configured as to permit the door to be removed by manually lifting the door out when it is in the ninety degree open position.

2 Claims, 9 Drawing Figures

EASY-LOCK REMOVABLE DOOR HINGE

BACKGROUND OF THE INVENTION

Modern day data processing systems are often made up of several processor units, several memory storage units, several control units and a variety of input output devices. Often each of these units is housed in one or more cabinets arranged within a specially designed computer room. The use of cabinets is particularly useful where the data processing system is modularized, i.e., its capacity can be increased or decreased by adding or removing cabinets. Such cabinets have found use more and more with the advent of circuit boards, each of which has mounted or otherwise formed thereon complete logic arrays. Several of these circuit boards may be removably disposed in each cabinet and are of such a nature that in the maintenance or trouble shooting of the data processing system they may be removed and replaced with little effort.

The cabinets which house such circuitry generally provide easy access for such replacement. Panels or doors secured to the cabinets by screws or the like which may be removed provide one manner in which such access may be provided.

Another way is simply to provide each cabinet with hinged doors which may be opened to allow maintenance or testing of the various components. Often times it is advantageous to remove the door completely to permit major repair or replacement of one or more defective circuit board or in the actual factory assembly of circuitry and electrical interconnection during the manufacturing process.

In the field where on site maintenance occurs, the various cabinets are generally arrayed in side by side or adjacent relationship. In such an environment, the door hinges must be such as to permit the door to be easily removed without serious interference with adjacent cabinets.

OBJECTS

It is an object of the present invention to provide a hinge arrangement to permit easy removal of a cabinet door.

It is another object of the present invention to provide a hinge arrangement which permits easy removal of a cabinet door but which prevents accidental removal of the door.

A further object of the present invention is to provide a hinge arrangement which facilitates rapid removal of a cabinet door, prevents accidental removal thereof and one in which the hinges are so designed as not to interfere with or damage adjacent cabinets.

DESCRIPTION OF THE INVENTION

Figure 1:
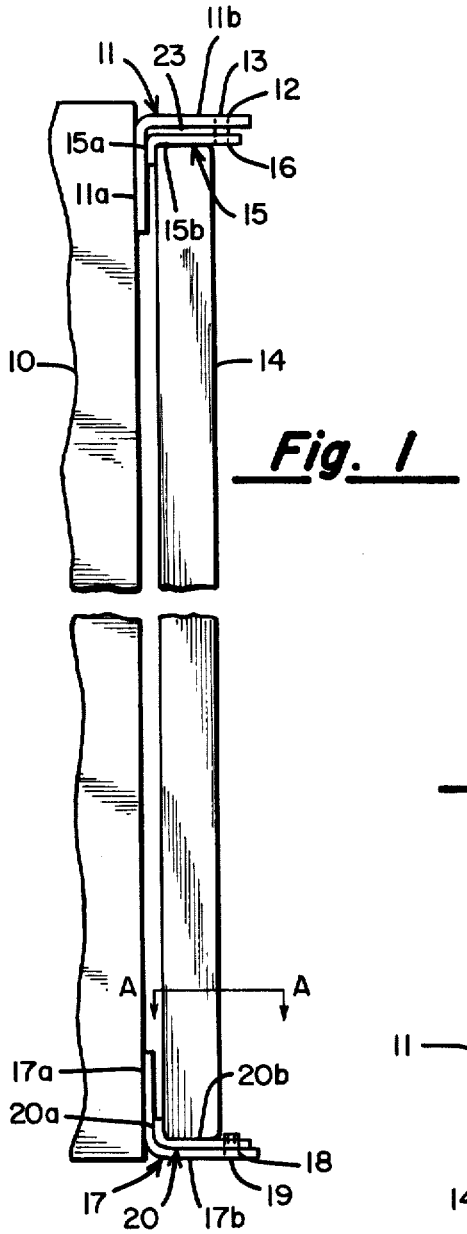
FIG. 1 illustrates a side view of the cabinet and door hinge arrangement of the present invention.

Referring now more particularly to FIG. 1 there is shown in partial outline, a cabinet 10 for housing various components of an electronic data processing system or other types of components, electronic or otherwise.

Secured to the upper left hand portion of the cabinet 10 is an L-shaped hinge 11. One length 11*a* of the hinge 11 is fixed to the cabinet by any convenient means, e.g., countersunk screws (not shown). The other length 11*b* of the hinge extends perpendicularly from the cabinet 10.

Figure 2:
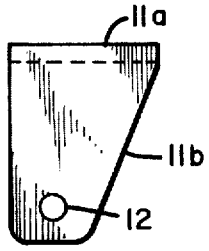
FIG. 2 shows a top view of the hinge for the top of the cabinet.

Length 11*b* has a hole 12 as best seen in FIG. 2 in which a pin 13 is firmly held, as for example, by a press fit. The pin 13 extends downwardly below the bottom surface of length 11*b* for cooperation with the upper door hinge as is described hereinbelow.

Secured to the upper left hand portion of a door 14 is an L-shaped hinge 15. The hinge 15 has a length 15*b* secured as by countersunk screws (not shown) to the upper edge of the door 14 and a length 15*a* which extends around the back of the door 14. The length 15*a* which is substantially less in dimension than length 11*a* abuts the length 11*a* when the door 14 is in the closed position as shown.

Figure 3:
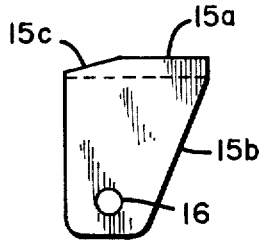
FIG. 3 shows a top view of the hinge for the top of the door.

A portion of length 15*b* extends beyond the door and as best seen in FIG. 3 has a hole 16 formed therein. The hole 16 has a diameter slightly greater than the diameter of the pin 13.

The pin 13 is received in hole 16 and supports the door 14 against lateral movement while at the same time permitting rotational movement when the door is opened and shut.

Secured to the lower left hand side of the cabinet 10 is another L-shaped hinge 17 substantially of the same configuration as hinge 11.

Figure 4:
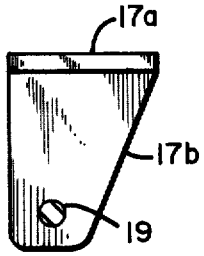
FIG. 4 shows a top view of the hinge for the bottom of the cabinet.

Hinge 17 has a length 17*a* secured as by countersunk screws (not shown) to the cabinet 10 and a length 17*b* which extends perpendicularly away from the cabinet 10. The length 17*b* has a hole 18 as best seen in FIG. 4 into which a pin 19 is secured as by a press fit. The pin 19 extends upwardly beyond the upper surface of the length 17*b*.

Figure 6A:
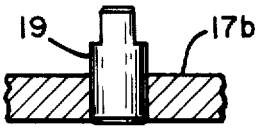
FIGS. 6*a* and 6*b* show a side and top view of the pin used for the hinge at the bottom of the door and cabinet.
Figure 6B:
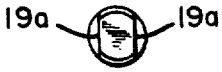

As seen in FIGS. 6*a* and 6*b* the upper half of the portion of the pin 19 which extends beyond the upper surface of the length 17*a* has cut portions which form opposite flat surfaces 19*a* the planes of which are perpendicular to the front of cabinet 10.

Secured to the lower edge of the door 14 is an L-shaped hinge 20. The hinge 20 is similar in configuration to the hinge 15. It has a length 20*a* disposed against the back of the door 14 and abutting length 17*a* of the hinge 17 with the length 20*a* being substantially shorter than the length 17*a*. The hinge 20 has a length 20*b* secured to the door as by countersunk screws (not shown) extending perpendicularly away from the door 14.

Figure 5:
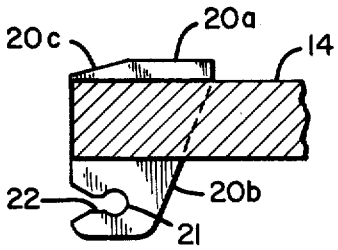
FIG. 5 shows a top view of the hinge for the bottom of the door and taken through line A—A of FIG. 1 with the hinge for the bottom of the cabinet removed.

The hinge 20 has a hole 21 in length 20*b* for receiving the pin 19. As seen in FIG. 5, extending from the hole 21 is a slot 22 the center line of which is always parallel to the front surface of the door 14 regardless of which position the door 14 happens to be in.

The slot 22 has a width less than the diameter of the hole 21 but greater than the distance between surfaces 19*a* of the pin 19.

As seen in FIG. 1 the door 14 effectively rests on the hinge 17. The portion of the pin 19 having the surfaces 19*a* protrudes beyond the hole 21. In this position, the pin 19 prevents lateral movement of the door while permitting its rotational movement as when the door 14 is open or shut.

From examination of FIGS. 2, 3, 4 and 5, it is apparent that the upper and lower hinges are in virtual coincidence when the door is in the closed position. It should be noted that the hinges are so configured and positioned that they do not interfere with adjacent cabinets.

Figure 7:
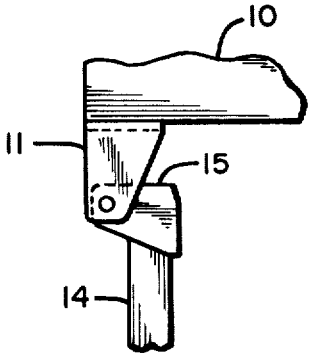
FIG. 7 shows the relationship of the hinges at the top of the cabinet and door when the door is in the ninety degree open position and, FIG. 8 shows the relationship of the hinges at the bottom of the cabinet and door when the door is in the ninety degree open position.
Figure 8:
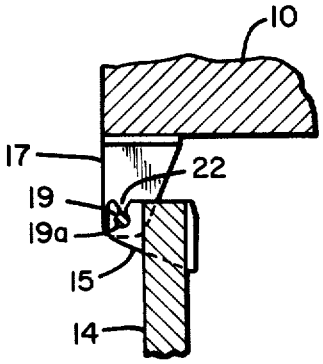

Likewise as seen in FIGS. 6 and 7 where the door 14 is shown in its 90° open position, neither of the hinges extends beyond a line extending from the side of the cabinet 10 and thus no inference exists with adjacent cabinets.

Also, as seen in FIG. 1 there is a gap 23 between hinges 11 and 12. Since the pin 13 loosely fits into hole 16 of the hinge length 15*b*, the door may be raised upwardly the distance of the gap 23.

As seen in FIGs. 3 and 5, hinges 15 and 20 are cut off to form surfaces 15*c* and 20*c* respectively on lengths 15*a* and 20*a* to facilitate opening and shutting the door 14. When the door 14 is in the 90° open position, the slot 22 is aligned with the width of the pin 19 between the surfaces 19*a*. In this position, the door 14 may be removed by raising the door 14 until the slot 22 is opposite the width defined by the surfaces 19*a*. At this point the bottom of the door is easily moved away from the cabinet since the pin 19 no longer restrains lateral movement in this direction.

When the door 14 has been removed at the bottom of the cabinet 10, the door is lowered somewhat until hole 16 is disengaged from the pin 13 and the door is then completely removed from the cabinet. As can be understood, such removal is done without the slightest interference with cabinets that may be adjacent.

Similarly, the door 14 may be placed back on the cabinet by holding the door 14 in the ninety degree open position and inserting pin 13 in hole 16. While holding the door up the pin 19 may be inserted in hole 21 of hinge length 10*b* by sliding the slot 22 past surfaces 19*a* of pin 19. When this is accomplished the door is lowered so that it rests on the length 17*b* of hinge 17. In this position the surfaces 19*a* are above slot 22 and the door is restrained from lateral movement since the diameter of the pin 19 is greater than the width of the slot 22.

Other modifications of the present invention are possible in light of the above description and the illustrations of the present invention set forth should not be construed as placing limitations on the present invention other than those contained in the claims which follow.

What is claimed is:

1. A hinge arrangement for facilitating the removal of a door from a cabinet, comprising in combination;

first hinge means connecting the door at its upper end to the cabinet, second hinge means connecting the door at its lower end to the cabinet, said second hinge means comprising;

a first plate having a hole and a slot extending from said hole opening toward the cabinet when the door is in the 90° open position, said slot having a width less than the diameter of said hole, a second plate secured to and extending from the cabinet supporting the weight of the door, said second plate having a pin secured therein and normally extending into said hole, said pin having a diameter less than the diameter of said hole but greater than the width of said slot, the upper portion of said pin being cut out to a width less than the width of said slot to permit the door to be removed from the lower end of the cabinet only when the door is in the 90° open position and lifted to a point where said cut out portion of said pin aligns with said slot, said first hinge means including means for releasing the upper part of the door from the cabinet when the lower part of the door has been removed from the cabinet.

2. A hinge arrangement according to claim 1 wherein said first hinge means comprises:

a first plate secured to and extending from the upper end of the cabinet, said first plate having a pin secured therein, a second plate secured to the extending from the upper end of the door, second plate having a hole for receiving said pin, said hole having a diameter slightly greater than the diameter of said pin to permit the upper end of the door to be removed from the cabinet when the lower end of the door has been removed from the cabinet, said first and second plates of said first hinge means being separated a slight distance to permit the door to be raised.

* * * * *